United States Patent [19]

Paluca

[11] Patent Number: 4,739,981

[45] Date of Patent: Apr. 26, 1988

[54] BICYCLE HOLDING ADAPTER FOR VISES

[76] Inventor: F. Daniel Paluca, 5 David St., Southampton, Mass. 01073

[21] Appl. No.: 911,752

[22] Filed: Sep. 26, 1986

[51] Int. Cl.[4] ..... B25B 1/24

[52] U.S. Cl. ..... 269/277

[58] Field of Search ..... 269/277–279, 269/285–286, 133, 239, 268–270; 81/421–424, 426.5

[56] References Cited

U.S. PATENT DOCUMENTS

| | | | |
|---|---|---|---|
| 465,959 | 12/1891 | Yerdon | 269/278 |
| 529,982 | 11/1894 | Wakefield | 269/278 |
| 1,101,396 | 6/1914 | Bowser et al. | 269/277 |
| 1,249,148 | 12/1917 | McClellan | 269/278 |
| 1,987,294 | 1/1935 | Haskins | 269/239 |
| 2,111,468 | 3/1938 | Corkum | 269/239 |

FOREIGN PATENT DOCUMENTS

| | | | |
|---|---|---|---|
| 627478 | 10/1927 | France | 269/277 |

*Primary Examiner*—Robert C. Watson

*Attorney, Agent, or Firm*—Chapin, Neal & Dempsey

[57] ABSTRACT

Bicycle holding adapter for vises is composed of two generally rectangular blocks hinged together along their lower inner edges for swinging movement between an "open" position in which the opposed inner surfaces of the blocks are outwardly diverging from the hinge of the adapter. In their "closed" position, the inner surfaces of the two blocks are disposed in parallel at least partially abutting relationship. Each block is provided with a longitudinally extending recess extending from end-to-end thereof and located to register in opposed relation when the blocks are swung "closed" to form a cavity for gripping the tubular frame of a bicycle. The undersurfaces of each block are oppositely inclined upwardly at an acute angle so that the adapter assumes a normally "open" position. The inner surface of each block outwardly of the recess is relieved to provide an access opening into the cavity forming recesses.

3 Claims, 2 Drawing Sheets

BICYCLE HOLDING ADAPTER FOR VISES

BACKGROUND OF THE INVENTION

This invention relates to a bicycle holding adapter or "Bike-Vise" for use in bench vises. The adapter enables the individual bicycle owner or "bike shop" to convert an ordinary bench vise into a clamping fixture especially adapted to hold a bicycle for repair and maintenance work.

The prior art includes a number of patents which disclose clamping fixtures of various types to be used in bench vises. U.S. Pat. No. 465,959, issued in 1891 to Verdon, discloses a jaw device with jaw linings for holding pipes in a vise without risk of damage to the pipes. The jaws are pivotably interconnected at their lower ends and their outer surfaces are especially dovetailed to be mounted in the jaws of a particular model vise so that the jaws will "open" and "close" with the vise.

U.S. Pat. No. 569,057 to Reilly, issued in 1896, also shows a vise clamp which is mounted on the upper surface of the vise jaws.

Another similar patent was issued in 1914 to Bowser as U.S. Pat. No. 1,101,396. The Bowser patent discloses a clamp in which its jaws are both slidably and pivotably interconnected to enable it to adjust to various diameter pipes. The patent calls for the clamp to be fitted about the pipe before placing the clamp in the vise. This clamp is not constructed to automatically assume an "open" position in the vise prepared to receive the object to be clamped.

There are a number of patents in which a clamping fixture is composed of two pivotable jaws which are configured to be supported by the jaws of the vise. These include U.S. Pat. Nos. 989,382; 1,110,683; 1,249,148; 1,288,178; 2,532,952 and 2,645,963.

While many of the prior art patents provide pipe gripping clamps, none is universally adapted for use in bench vises of any type and which automatically assume a partially "open" stable position in the vise especially adapted to enable a bicycle frame to be readily placed in the adapter using one hand with the other hand being free to tighten the bench vise to clamp the bicycle frame therein.

The principal object of this invention is to provide a bicycle holding adapter of simple and economical construction and which is simple to use in an ordinary bench vise.

It is another object of this invention to provide an adapter of the above type which is especially adapted to receive and support a bicycle frame in an "open" vise and to firmly clamp the same in fixed position when the vise is "closed" to clamp the adapter therein.

It is a further object of this invention to provide a vise adapter of the above type which will clamp and securely hold a bicycle frame for repair or maintenance work thereon without marring or damagint the bicycle frame.

It is yet another object of this invention to provide a vise adapter of the above type which can be readily placed in any type of bench vise and operated regardless of the external contours of the vise jaws.

The above and other objects and advantages of this invention will be more readily apparent from the following detailed description read in conjunction with the accompanying drawings in which.

Figure 1:
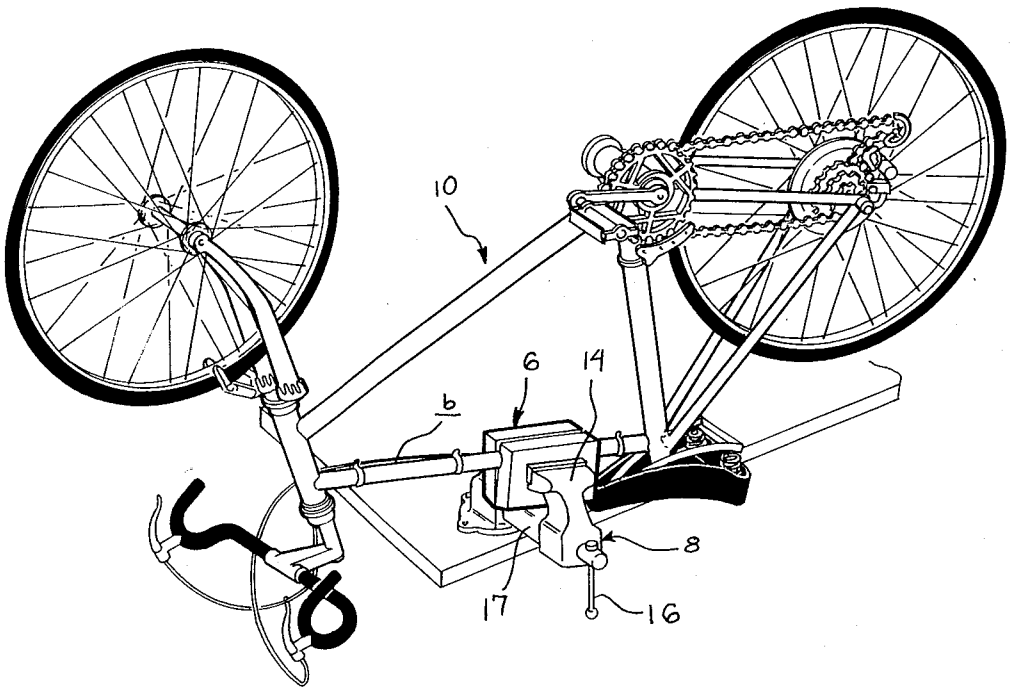
FIG. 1 is an overall view of a bicycle holding adapter for a vise illustrating the manner of using an adapter embodying this invention.

Referring to the drawings in detail, in FIG. 1 is shown an adapter 6 of the type embodying this invention disposed within a bench vise 8 and supporting the tubular frame of a bicycle 10 in fixed position to enable the "bike" to be repaired or otherwise serviced.

The vise includes fixed and movable jaws 12 and 14 which are "opened" and "closed" by a feed-screw operated by a rotatable handle or lever 16. The vise includes a slide 17 movable relative to the fixed vise jaw and the adapter is supported in the vise by the slide 17.

The adapter 6 comprises a pair of generally rectangular blocks 20 and 22 of any suitably rigid material, such as wood, metal, a molded synthetic plastic structure or combinations of these materials. Preferably, the bicycle gripping surfaces should have sufficient elasticity so as not to mar the bicycle frame when clamped by the adapter. This purpose may be accomplished by selection of the block forming material per se, or by suitably coating the inner bike gripping surfaces of the blocks.

Figure 2:
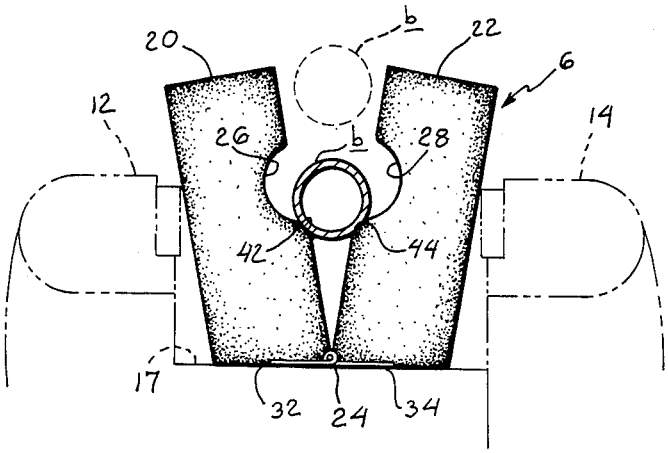
FIG. 2 is an elevational view showing one end of the adapter in an "open" condition.

The blocks are identical in configuration and each has generally planar outer surfaces. The blocks may be of any suitable size to securely clamp and hold the bicycle for repair or maintenance work. The length of the block must be sufficient to hold the bicycle frame in a stable condition during such work. The other dimensions are selected to be accommodated in the ordinary bench vise. It has been found that a length 1 (FIG. 4) of 6-inches, a height h of about 4-inches and a thickness t of about $1\frac{1}{2}$-inches have provided an adapter which will perform in an effective manner for all known types of bench vises. The two blocks are hinged together at their lower inner edges as at 24 so that they can be swung "open", as illustrated in FIG. 2 and "closed" as in FIG. 3. The hinge may be either a separate part or an integrally formed continuation of the block material itself.

Figure 3:
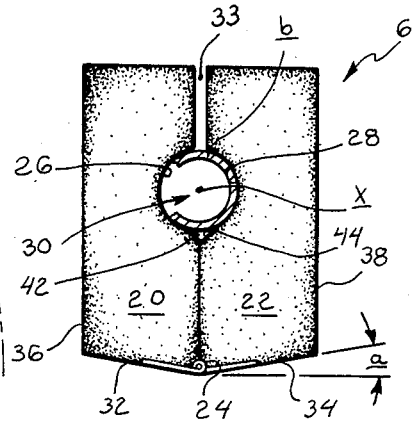
FIG. 3 is a view similar to FIG. 2 but with the adapter shown in "closed" condition, clamping a bicycle frame therein.

As shown, an inwardly opening semi-circular channel or recess 26 and 28 is provided at corresponding locations on the inner surface of each block. Thus, when the blocks are swung "closed", as depicted in FIG. 3, the two opposed recesses define a longitudinally extending cylindrical bore or cavity 30 (FIG. 3) which runs the full length of the adapter and is open at both ends. The diameter of the cavity 30 is dimensioned to snugly grip the tubular frame b of a bicycle which is generally about 1-inch in diameter. The lower edge of the cavity is about one-half the height of the blocks, whereby the cavity 30 will be located above the geometric center of the adapter. The only requirement is that the axis x of the cavity 30 be at or above the top surfaces of the vise jaws 12 and 14 of the bench vise where the jaws contact the outer surfaces of the blocks 20 and 22 when the blocks are supported by the vise slide 17 or feed-screw. This requirement means that all the clamping force vectors will be at or below the longitudinal axis of the cavity, thus eliminating any strain on the hinge 24 of the adapter. If the vise should be too deep to meet this requirement, a small spacer board or block may be interposed between the adapter and the upper surface of the vise slide 17. From the hinge to the lower edge of the cavity, the inner surfaces of the two blocks 20 and 22 are parallel and when the blocks are "closed", these surfaces are in abutting relation (FIG. 3). Above the cavity 30, the two inner surfaces are spaced apart, as at 33, thus leaving a space or gap of about one-half inch. This gap provides an access opening for ease of placing the tubular frame of a bicycle into the cavity of the adapter, such as depicted at b in FIG. 2.

The lower surfaces 32 and 34 of blocks 20 and 22 are each inclined, tapered or beveled from the hinge 24 to the outer surfaces 36 and 38 of the blocks at an angle a of about 10°. Thus, as depicted in FIG. 2, when the two lower surfaces are coplanar, as when supported on the upper surface of the slide 17 or feed-screw of a vise, the jaws 20 and 22 will be disposed in outward diverging or "open" relationship at an angle of approximately 20°.

With this construction, when the adapter 6 is placed in a vise which is "open", the adapter will automatically come to rest in its "open" condition, as depicted in FIG. 2. In this position, the tubular frame b of a bicycle can be readily inserted into the adapter and come to rest on the lower edge portions of the recesses 26 and 28. These edges are preferably chamfered or beveled as at 42 and 44 so as to provide greater surface areas of support for the cylindrical frame member b. These chamfered edges also provide a channel or clearance for the brake and/or shifting cable which are frequently fastened along the upper edge of the frame member b.

Figure 4:
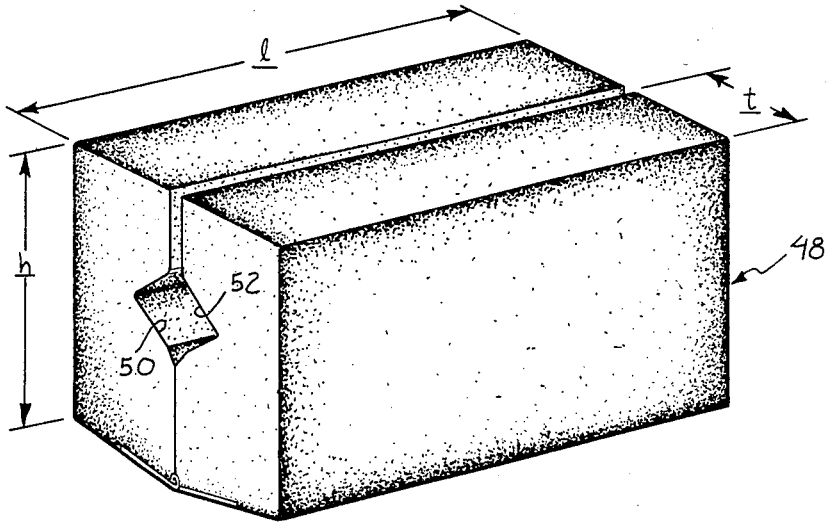
FIG. 4 is a perspective view of an alternative embodiment of the adapter.

In FIG. 4, is illustrated an alternative embodiment 48 of the vise adapter embodying this invention. The adapter 48 is, in all respects, similar to my adapter 6, except that recesses 50 are polygonal in shape instead of semi-circular. Of course, it will be realized that the recesses may be of any suitable configuration without departing from the concept of this invention.

This invention thus provides a highly efficient tool or fixture for securely holding a bicycle frame in a stable position but one which is nonetheless extremely simple and economical in construction while being easy for an amateur to use as well as the bike shop operator.

Having thus disclosed my invention, what is claimed is:

1. Bicycle holding adapter used in a bench vise consisting essentially of a pair of unitary blocks hinged together at their lower inner edge portions, each block being generally rectangular in cross-section, the undersurface of each block being inclined upwardly at a substantial oblique angle from the hinge toward the outer side surface thereof, whereby the adapter, by force of gravity, will normally come to rest in an "open" position, in said "open" position, the inner surfaces of said blocks diverging outwardly from said hinge with the bottom surfaces of the adapter being supported by the slide of said bench vise, the height of each block measured from the undersurface thereof to its upper surface being substantially greater than the height of the jaws of said bench vise measured from said slide, each block having a recess extending longitudinally from end-to-end across the inner surface thereof, the recess being dimensioned and disposed to register in opposed relation to define a cavity when the blocks are swung to their "closed" position by the jaws of the bench vise thereby being adapted to clamp therein a tubular frame of a bicycle, the length of each block measured parallel to said cavity being substantially greater than the corresponding dimension of the jaws of said bench vise.

2. Bicycle holding adapter for vises as set forth in claim 1, in which the longitudinal axis of said cavity is generally above the upper edge of the vise jaws and in which the portions of said blocks above said recesses are relieved to provide an access opening into the cavity forming recesses of the adapters.

3. Bicycle holding adapter for vises as set forth in claim 2, in which the lower edge portions of the cavities are beveled to provide greater surface areas of support for the cylindrical frame member of a bicycle and to provide clearance for a brake or shifting cable disposed along the upper edge of said frame member of the bicycle.

* * * * *